US005293912A

United States Patent [19]

Wildash et al.

[11] Patent Number: 5,293,912

[45] Date of Patent: Mar. 15, 1994

[54] WINE BREATHER

[76] Inventors: Timothy J. Wildash, Unit 3, 23 Glynden Ave, Brighton, Victoria, Australia, 3186; Alun F. Bartsch, 21 Foote Street, Elwood, Victoria, Australia, 3084

[21] Appl. No.: 913,730

[22] Filed: Jul. 16, 1992

[51] Int. Cl.[5] ..... B65B 39/00

[52] U.S. Cl. ..... 141/344; 141/106; 141/264; 141/331; 239/520

[58] Field of Search ..... 141/331, 332, 333, 391, 141/392, 100, 104, 106, 264; 222/564; 239/520

[56] References Cited

U.S. PATENT DOCUMENTS 1,290,968 1/1919 Gillette ..... 141/331
4,269,236 5/1981 Fogg ..... 141/392

FOREIGN PATENT DOCUMENTS 985030 3/1965 United Kingdom ..... 141/392

*Primary Examiner*—Ernest G. Cusick
*Assistant Examiner*—David J. Walzack
*Attorney, Agent, or Firm*—Larson & Taylor

[57] ABSTRACT

A wine breather is disclosed which comprises a cylindrical and horn shaped container (10) which tapers downwardly from an inlet (12) to an outlet (14). A valve (16) is arranged at the outlet which has an annular outlet passage (42) angled at a transverse angle to the longitudinal axis of the container (10). Wine is poured into the open end (12) and passes through the container (10) to exit the passage (42) in a thin sheet forming a generally hemispherical flow of wine which presents a substantially large surface area of wine for contact with the air to cause the wine to breathe.

1 Claim, 1 Drawing Sheet

WINE BREATHER

This invention relates to a device for exposing a liquid to air and in particular, but not exclusively to a wine breather for exposing red wine to air to allow the red wine to breathe before consumption.

As is well known, it is desirable to allow red wine to breathe before consumption. Normally this takes place by opening a bottle of red wine and allowing the wine to breathe in the bottle for several hours before consumption. Alternatively, the wine may be poured into a decanter or carafe and allowed to breathe in the decanter or carafe for several hours before consumption.

If it is desired to consume red wine on short notice it is therefore necessary to consume the wine without allowing it to breathe which reduces the enjoyment of the wine.

The object of this invention is to provide a device for exposing a liquid to air which will enable the liquid to breathe in a short time period so that in the case of the liquid being red wine the red wine can be consumed substantially immediately and full enjoyment of the wine achieved.

The invention may be said to reside in a device for exposing a liquid to air comprising:

a container for receiving the liquid and for forming a reservoir for the liquid, said container having an upper opening for allowing the liquid to be poured into the container and a lower outlet for allowing the liquid to leave the container, said lower outlet being such that the liquid, in use, flows radially outwardly and downwardly in a relatively thin sheet so that the liquid exiting the container exposes a substantial area to air so that it breathes as it exits the container and passes to a receptacle.

Thus, to allow the liquid, such as wine, to breathe it is only necessary to pour the wine into the container whilst the container is held above a receptacle such as a carafe or decanter and the wine will gently flow out of the outlet in a manner such that it presents a substantial surface area to air so that it breathes substantially immediately and is ready for consumption as soon as it is received in the carafe or decanter.

Preferably the outlet includes a valve element which has an upper portion which substantially seals against the internal surface of the container and a lower portion which includes a tapered section which is spaced from a lower extremity of the container to define a generally angular outlet passage which is angled outwardly with respect to a longitudinal axis of the container so that the liquid balloons outwardly from the outlet of the container as it flows from the reservoir and through the valve element so as to present a large surfaced area to the air.

In use, preferably the device is used in combination with a carafe and the portion of the container having the outlet is located in a carafe so that when the liquid balloons outwardly from the outlet passage it contacts the side of the carafe and gently flows down the side of the carafe into the carafe.

A preferred embodiment of the invention will be described, by way of example, with reference to the accompanying drawings in which.

Figure 1:
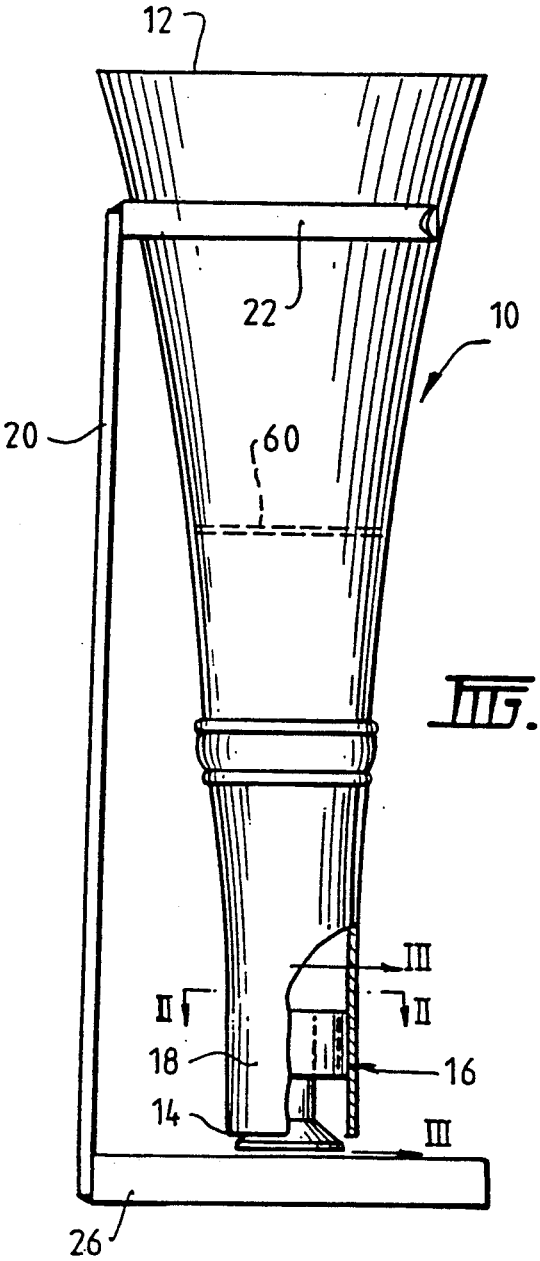
FIG. 1 is a perspective view partly broken away of the device embodying the invention.

With reference to FIG. 1, the device generally comprises a container 10 which is cylindrical and horn shaped and tapers downwardly from an inlet opening 12 to an outlet 14.

The outlet 14 includes a valve element 16. The tapering of the container 10 ceases slightly above the valve element 16 so that a cylindrical wall portion 18 of the container 10 in the vicinity of the valve element 16 is substantially parallel.

As shown in FIG. 1 the device may be supported by a stand 20 which includes a ring 22 for receiving the container 10 and a base 26 for supporting the stand.

Figure 2:
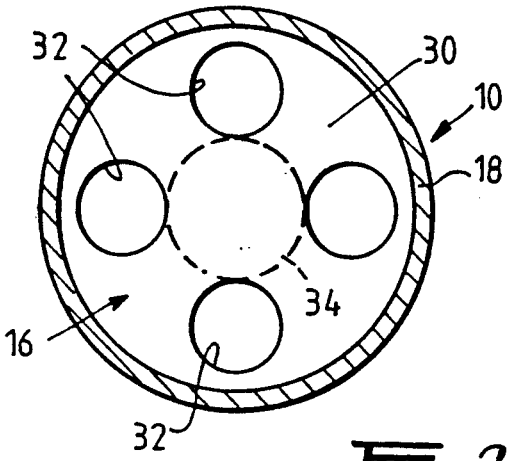
FIG. 2 is a cross-sectional view along the line II—II of FIG. 1.
Figure 3:
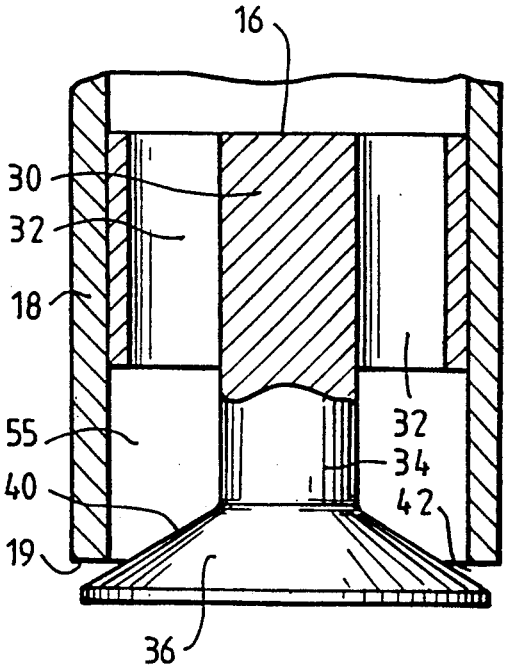
FIG. 3 is a cross-sectional view along the line III—III of FIG. 1.

As is best seen in FIGS. 2 and 3 the valve element 16 includes an upper cylindrical section 30 which is provided with a plurality of holes 32.

The element 16 includes a reduced diameter stem portion 34 and a tapered foot section 36.

The valve element 16 is received in the cylindrical portion 18 of the container 10 simply by inserting the valve element from the bottom so that the section 30 is a friction fit in the container 10.

As is clearly seen in FIG. 3, the foot section 36 has a inclined annular surface 40 which extends from the stem 34 to a position just below the bottom extremity 19 of the container. The inclined surface 40 and the bottom extremity of the container 10 define an annular outlet passage 42 which is generally angled at an angle transverse to the longitudinal axis of the container 10.

Figure 4:
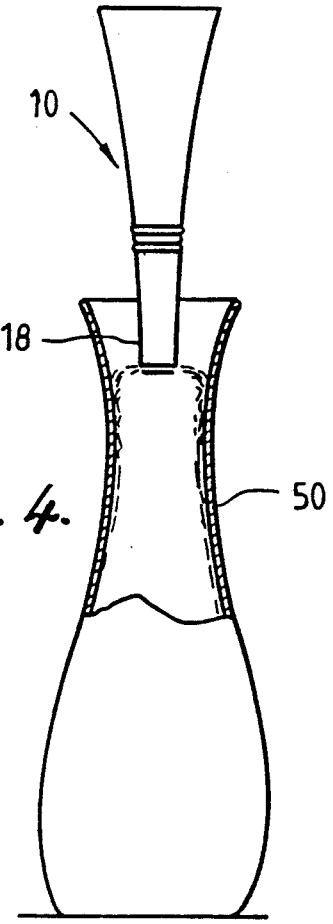
FIG. 4 is a view showing the device in use.

In order to use the device to allow a liquid, such as red wine, to breathe, as is best shown in FIG. 4, the red wine is poured into the top opening 12 as the device is held in the hand with the lower part of the device received in a carafe 50. The wine is allowed to fill the portion of the container 10 above the valve element 16 which therefore forms a reservoir for the red wine. The red wine which is poured into the device 10 will pass through the plurality of openings 32 in the valve element 16 into the chamber 55 between the stem 34 and the cylindrical wall 18 and will flow outwardly through the outlet passage 42. In view of the slope of the surface 40 and the general direction of the outlet passage 42 which is transverse to the longitudinal axis of the container 10, the wine will balloon outwardly as it leaves the passage 42 into a thin sheet forming generally hemispherical flow of wine which thereby presents a substantially large surface area of wine for contact with the air which in turn causes the wine to breathe.

If the device 10 is held in a carafe 50 as is shown in FIG. 4, the wine which balloons outwardly from the outlet passage 42 will contact the internal surface of the carafe as is shown and will, through surface tension, flow down the sides of the carafe 50 into the carafe 50. The gentle flow of wine into the device 10 as it is poured from a bottle and through the valve element 16 onto the internal surfaces of the carafe 50 ensure that the wine is not disturbed but is adequately aerated so that it breathes substantially immediately and is ready for consumption once it enters the carafe 50.

If the wine includes sediment the device 10 may have a removable filter 60 (see FIG. 1) which can be inserted into the container and removed and cleaned when necessary.

Since modifications within the spirit and scope of the invention may readily be effected by persons skilled within the art, it is to be understood that this invention is not limited to the particular embodiment described by way of example hereinabove.

The claims defining the invention are provided:

1. A wine breather for breathing wine poured from a bottle, comprising:

a container for receiving the wine and for forming a reservoir for the wine;

an upper opening in the container for allowing the wine to be poured into the container;

a lower outlet in the container for allowing the wine to leave the container, the upper opening being larger than the lower outlet and the lower outlet having a bottom extremity; and a valve element arranged in the outlet, the valve element having a cylindrical body section which is frictionally secured in the lower outlet, the cylindrical body section having a plurality of holes therethrough, a stem connected to and extending downwardly from the cylindrical body section and being of smaller diameter than the body section, a tapered foot section connected to the stem and having an inclined surface section, the inclined surface section extending to a position at least below the bottom extremity of the outlet, the inclined surface section and the bottom extremity of the outlet defining a substantially annular outlet passage such that the wine, when poured into said upper opening of the wine breather, flows through said plurality of holes and over said inclined surface section so as to balloon outwardly from the passage in a relatively thin sheet to expose a substantial area to air so that the wine breathes as it exits the container and passes to a receptacle.

* * * * *